US006729420B2

(12) United States Patent
Mensa-Wilmot

(10) Patent No.: US 6,729,420 B2
(45) Date of Patent: May 4, 2004

(54) MULTI PROFILE PERFORMANCE ENHANCING CENTRIC BIT AND METHOD OF BIT DESIGN

(75) Inventor: Graham Mensa-Wilmot, Houston, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 10/105,755

(22) Filed: Mar. 25, 2002

(65) Prior Publication Data

US 2003/0178232 A1 Sep. 25, 2003

(51) Int. Cl.[7] ..... E21B 10/26
(52) U.S. Cl. ..... 175/385; 175/327; 175/334
(58) Field of Search ..... 175/385, 327, 175/334

(56) References Cited

U.S. PATENT DOCUMENTS 5,678,644 A * 10/1997 Fielder ..... 175/391
5,992,548 A * 11/1999 Silva et al. ..... 175/391
6,412,579 B2 * 7/2002 Fielder ..... 175/385
6,464,024 B2 * 10/2002 Beaton et al. ..... 175/391
2002/0157869 A1 * 10/2002 Glass et al. ..... 175/40

FOREIGN PATENT DOCUMENTS

EP 0 962 620 12/1999

OTHER PUBLICATIONS

British Patent Office Search Report for Appln. No. GB 0306456.5 dated Jul. 7, 2003; (2p).

* cited by examiner

*Primary Examiner*—David Bagnell
*Assistant Examiner*—Giovanna Collins
(74) *Attorney, Agent, or Firm*—Conley Rose, P.C.

(57) ABSTRACT

A novel drill bit includes a cutting reamer portion that cuts to gage diameter, and a pilot portion that cuts to a radius about 50%–80% of the reamer portion. The pilot portion extends downward from the reamer portion to create a distinct cutting area including pilot. The torque and weight on bit is evenly distributed between said pilot portion and said reamer portion of said drill bit by iterative adjustment of criteria such as backrake, siderake, cutter height, cutter size, and blade spacing.

29 Claims, 7 Drawing Sheets

MULTI PROFILE PERFORMANCE ENHANCING CENTRIC BIT AND METHOD OF BIT DESIGN

CROSS-REFERENCE TO RELATED APPLICATIONS

None.

REGARDING FEDERALLY SPONSORED RESEARCH OR DEVELOPMENT

Not Applicable.

BACKGROUND OF THE INVENTION

The invention relates generally to drill bits. More particularly, the invention relates to a drill bit designed to improve the drill bit's rate of penetration and longevity. Even more particularly, the invention relates to a drill bit having a pilot cutting surface on the drill bit face that extends from a reamer portion on the drill bit face that cuts to the full diameter of the drill bit, the drill bit being further designed to reduce bit vibration and extend longevity.

In drilling a borehole in the earth, such as for the recovery of hydrocarbons or for other applications, it is conventional practice to connect a drill bit on the lower end of an assembly of drill pipe sections which are connected end-to-end so as to form a "drill string." The drill string is rotated by apparatus that is positioned on a drilling platform located at the surface of the borehole. Such apparatus turns the bit and advances it downward, causing the bit to cut through the formation material by either scrapping, fracturing, or shearing action, or through a combination of all cutting methods. While the bit rotates, drilling fluid is pumped through the drill string and directed out of the drill bit through nozzles that are positioned in the bit face. The drilling fluid cools the bit and flushes cuttings away from the cutting structure and face of the bit. The drilling fluid and cuttings are forced from the bottom of the borehole to the surface through the annulus that is formed between the drill string and the borehole.

Drill bits in general are well known in the art. Such bits include diamond impregnated bits, milled tooth bits, tungsten carbide insert ("TCI") bits, polycrystalline diamond compacts ("PDC") bits, and natural diamond bits. In recent years, the PDC bit has become an industry standard for cutting formations of grossly varying hardnesses. The cutter elements used in such bits are formed of extremely hard materials, which sometimes include a layer of thermally stable polycrystalline ("TSP") material or polycrystalline diamond compacts ("PDC"). In the typical PDC bit, each cutter element or assembly comprises an elongate and generally cylindrical support member which is received and secured in a pocket formed in the surface of the bit body. A disk or tablet-shaped, hard cutting layer of polycrystalline diamond is bonded to the exposed end of the support member, which is typically formed of tungsten carbide. The cutting elements or cutting elements are mounted on a rotary bit and oriented so that each PDC engages the rock face at a desired angle. Although such cutter elements historically were round in cross section and included a disk shaped PDC layer forming the cutting face of the element, improvements in manufacturing techniques have made it possible to provide cutter elements having PDC layers formed in other shapes as well.

The selection of the appropriate bit and cutting structure for a given application depends upon many factors. One of the most important of these factors is the type of formation that is to be drilled, and more particularly, the hardness of the formation that will be encountered. Another important consideration is the range of hardnesses that will be encountered when drilling through layers of differing formation hardness. In running a bit, the driller may also consider weight on bit, the weight and type of drilling fluid, and the available or achievable operating regime. Additionally, a desirable characteristic of the bit is that it be "stable" and resist vibration.

Depending upon formation hardness, certain combinations of the above-described bit types and cutting structures will work more efficiently and effectively against the formation than others. For example, a milled tooth bit generally drills relatively quickly and effectively in soft formations, such as those typically encountered at shallow depths. By contrast, milled tooth bits are relatively ineffective in hard rock formations as may be encountered at greater depths. For drilling through such hard formations, roller cone bits having TCI cutting structures have proven to be very effective. For certain hard formations, fixed cutter bits having a natural diamond cutting element provide the best combination of penetration rate and durability. In soft to hard formations, fixed cutter bits having a PDC cutting element have been employed with varying degrees of success.

The cost of drilling a borehole is proportional to the length of time it takes to drill the borehole to the desired depth and location. The drilling time, in turn, is greatly affected by the number of times the drill bit must be changed in order to reach the targeted formation. This is because each time the bit is changed, the entire drill string, which may be miles long, must be retrieved from the borehole section by section. Once the drill string has been retrieved and the new bit installed, the bit must be lowered to the bottom of the borehole on the drill string which must be reconstructed again, section by section. As is thus obvious, this process, known as a "trip" of the drill string, requires considerable time, effort and expense. Accordingly, it is always desirable to employ drill bits that will drill faster and longer and that are usable over a wider range of differing formation hardnesses.

The length of time that a drill bit is kept in the hole before the drill string must be tripped and the bit changed depends upon a variety of factors. These factors include the bit's rate of penetration ("ROP"), its durability or ability to maintain a high or acceptable ROP, and its ability to achieve the objectives outlined by the drilling program. Operational parameters such as weight on bit (WOB) and RPM have a large influence on the bit's rate of penetration. Weight on bit is defined as the force applied along the longitudinal axis of the drill bit.

A known drill bit is shown in FIG. 1. Bit 10 is a fixed cutter bit, sometimes referred to as a drag bit or PDC bit, and is adapted for drilling through formations of rock to form a borehole. Bit 10 generally includes a bit body having shank 13, and threaded connection or pin 16 for connecting bit 10 to a drill string (not shown) which is employed to rotate the bit for drilling the borehole. Bit 10 further includes a central axis 11 and a cutting structure on the face 14 of the drill bit, preferably including various PDC cutter elements 40. Also shown in FIG. 1 is a gage pad 12, the outer surface of which is at the diameter of the bit and establishes the bit's size. Thus, a 12" bit will have the gage pad at approximately 6" from the center of the bit.

As best shown in FIG. 2, the drill bit body 10 includes a face region 14 and a gage pad region 12 for the drill bit. The face region 14 includes a plurality of cutting elements 40 from a plurality of blades, shown overlapping in rotated profile. Referring still to FIG. 2, bit face 24 may be said to be divided into three portions or regions 25, 26, 27. The most central portion of the face 24 is identified by the reference numeral 25 and may be concave as shown. Adjacent central portion 25 is the shoulder or the upturned curved portion 26. Next to shoulder portion 26 is the gage portion 27, which is the portion of the bit face 24 which defines the diameter or gage of the borehole drilled by bit 10. As will be understood by those skilled in the art, the boundaries of regions 25, 26, 27 are not precisely delineated on bit 10, but instead are approximate and are used to describe better the structure of the drill bit and the distribution of its cutting elements over the bit face 24.

The action of cutting elements 40 drills the borehole while the drill bit body 10 rotates. Downwardly extending flow passages 21 have nozzles or ports 22 disposed at their lowermost ends. Bit 10 includes six such flow passages 21 and nozzles 22. The flow passages 21 are in fluid communication with central bore 17. Together, passages 21 and nozzles 22 serve to distribute drilling fluids around the cutter elements 40 for flushing formation cuttings from the bottom of the borehole and away from the cutting faces 44 of cutter elements 40 when drilling.

Gage pads 12 abut against the sidewall of the borehole during drilling, and may include wear resistant materials such as diamond enhanced inserts ("DEI") and TSP elements. The gage pads can help maintain the size of the borehole by a rubbing action when cutting elements on the face of the drill bit wear slightly under gage. The gage pads 12 also help stabilize the PDC drill bit against vibration.

However, although this general drill bit design has enjoyed success, improvements in bit longevity, rate of penetration and performance are still desired. A faster, longer life drill bit will result in longer runs at lower costs, thus improving operation efficiency.

BRIEF DESCRIPTION OF THE FIGURES

For a more detailed description of the preferred embodiment of the present invention, reference will now be made to the accompanying drawings, wherein.

DETAILED DESCRIPTION OF THE INVENTION

Figure 1:
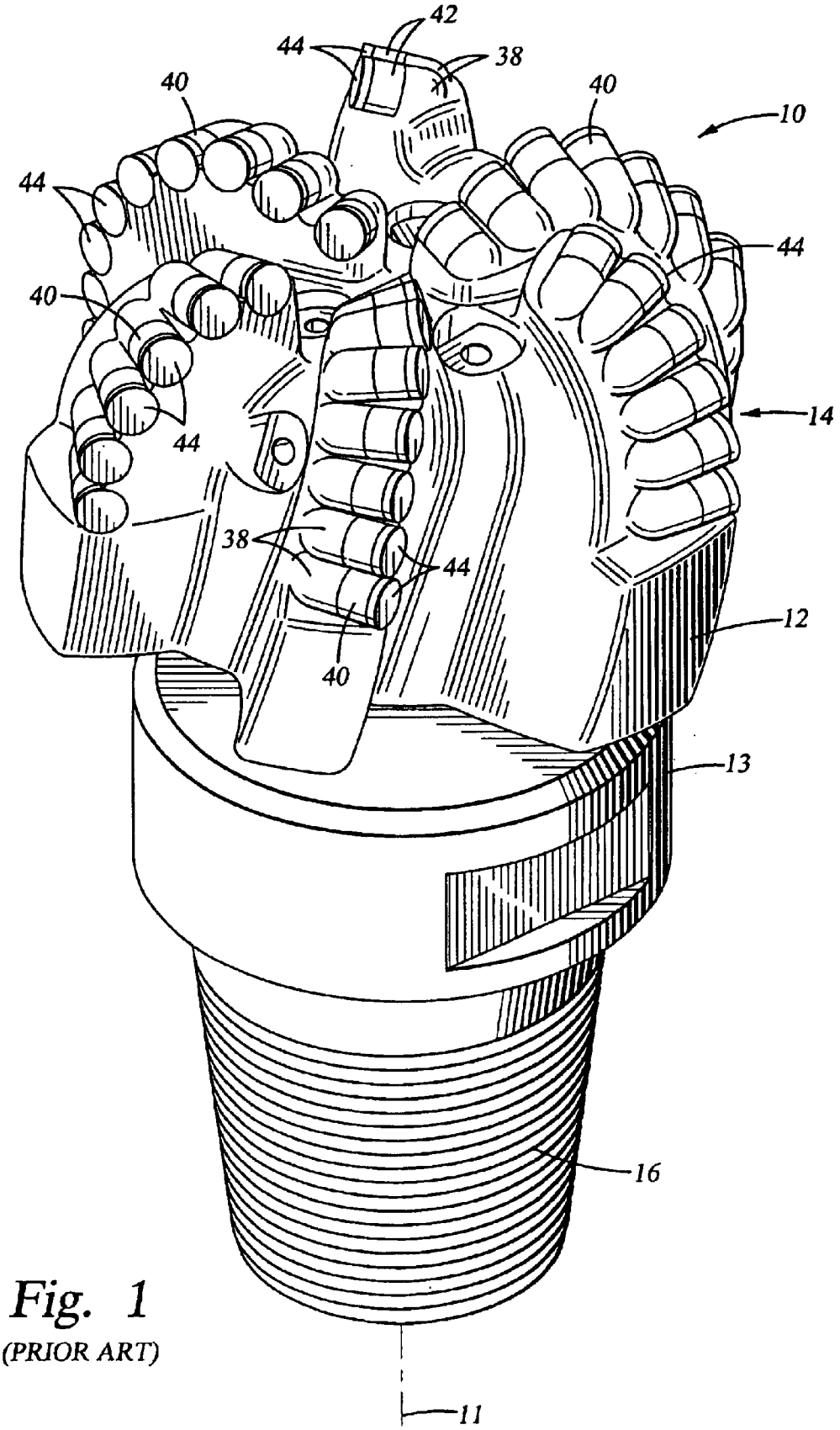
Fig. 1 (PRIOR ART)
FIG. 1 is a cut-away view of a prior art drill bit design.
Figure 2:
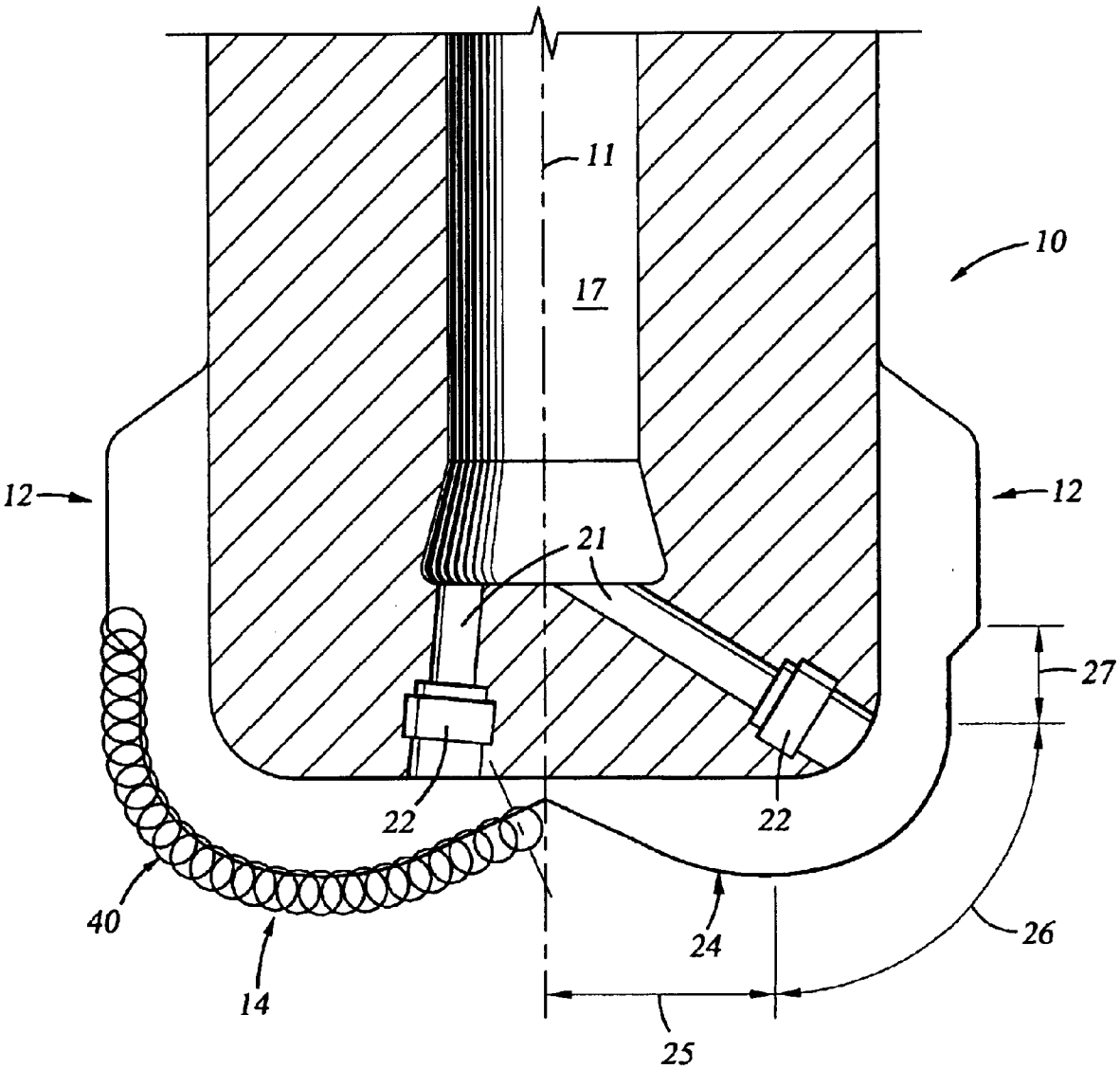
Fig. 2 (PRIOR ART)
FIG. 2 is an end-view of the drill bit of FIG. 1.
Figure 3:
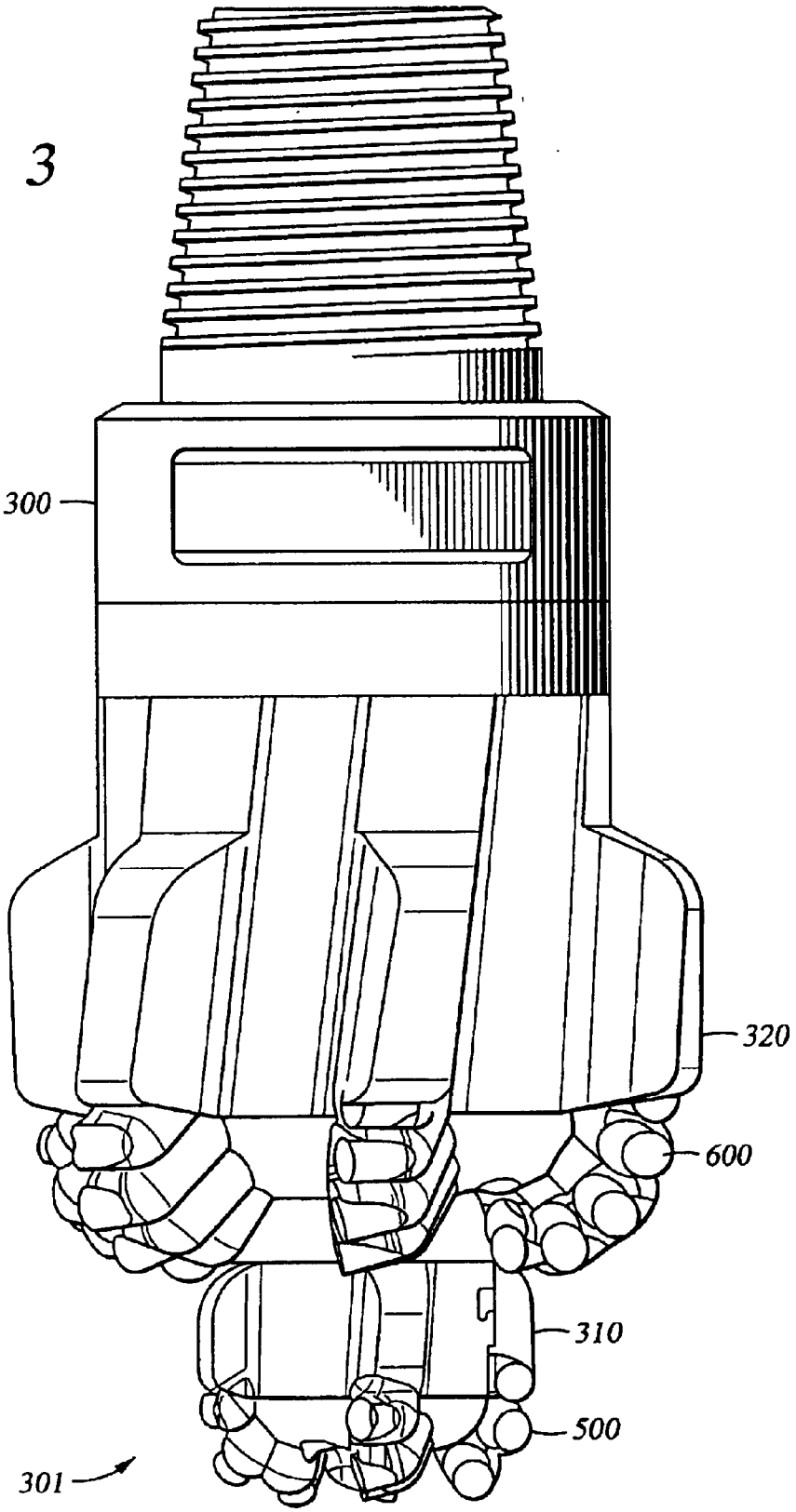
FIG. 3 is an isometric view of one embodiment of the invention.
Figure 5:
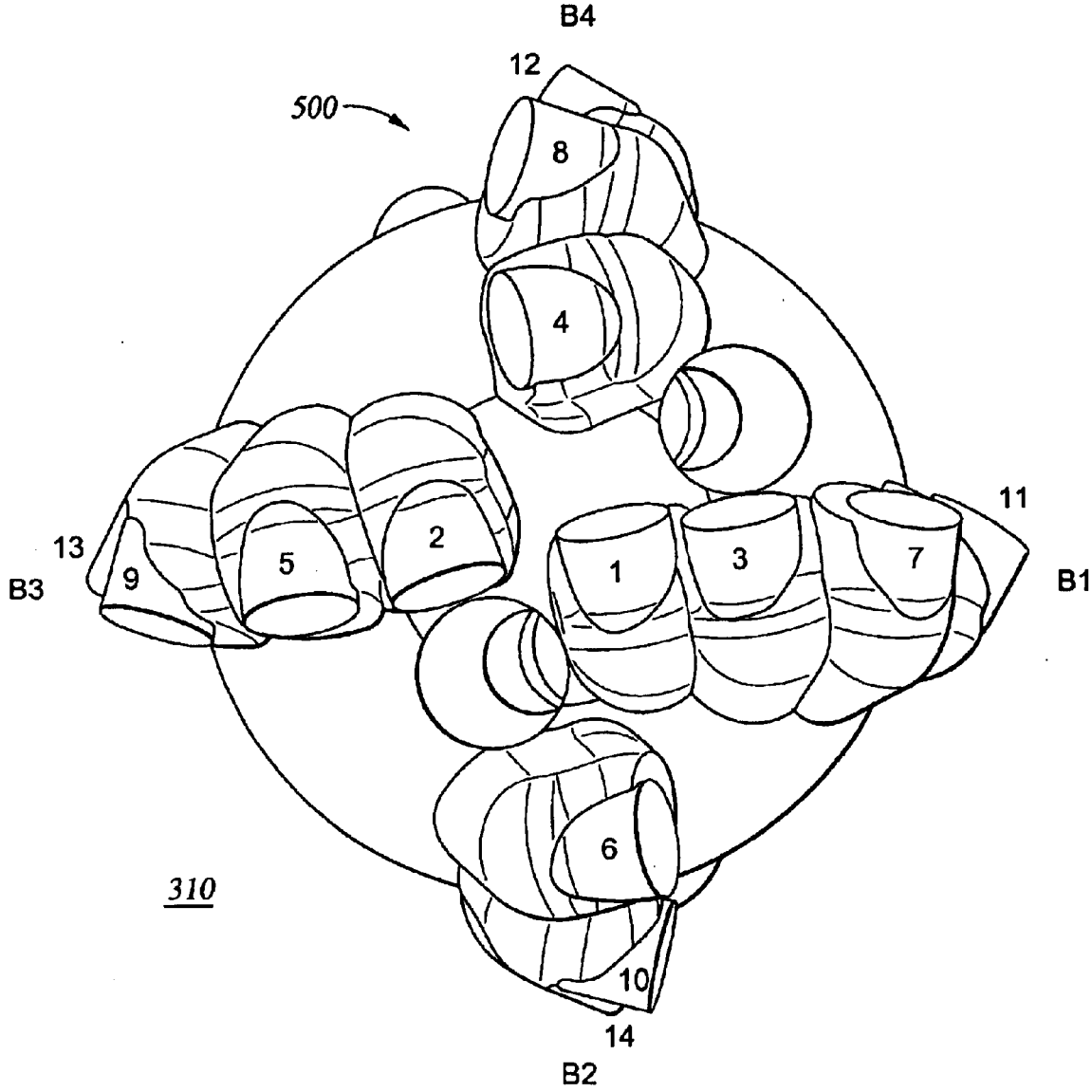
FIG. 5 is an end view of the pilot portion of the drill bit of FIG. 3.

FIG. 3 shows a PDC drill bit according to one embodiment of the invention. A drill bit body 300 includes a face, generally at 301. The face of the drill bit includes pilot portion 310 and reamer portion 320. Pilot portion 310 may be identified by its extension from reamer portion 320. Pilot portion 310 includes a first set of cutting elements 500, as better shown in FIG. 5. Reamer portion 320 includes a second set of cutting elements 600, as better shown in FIG. 6. The cutting elements may be arranged in an overlapping spiral or redundant manner, as is generally known.

Figure 4:
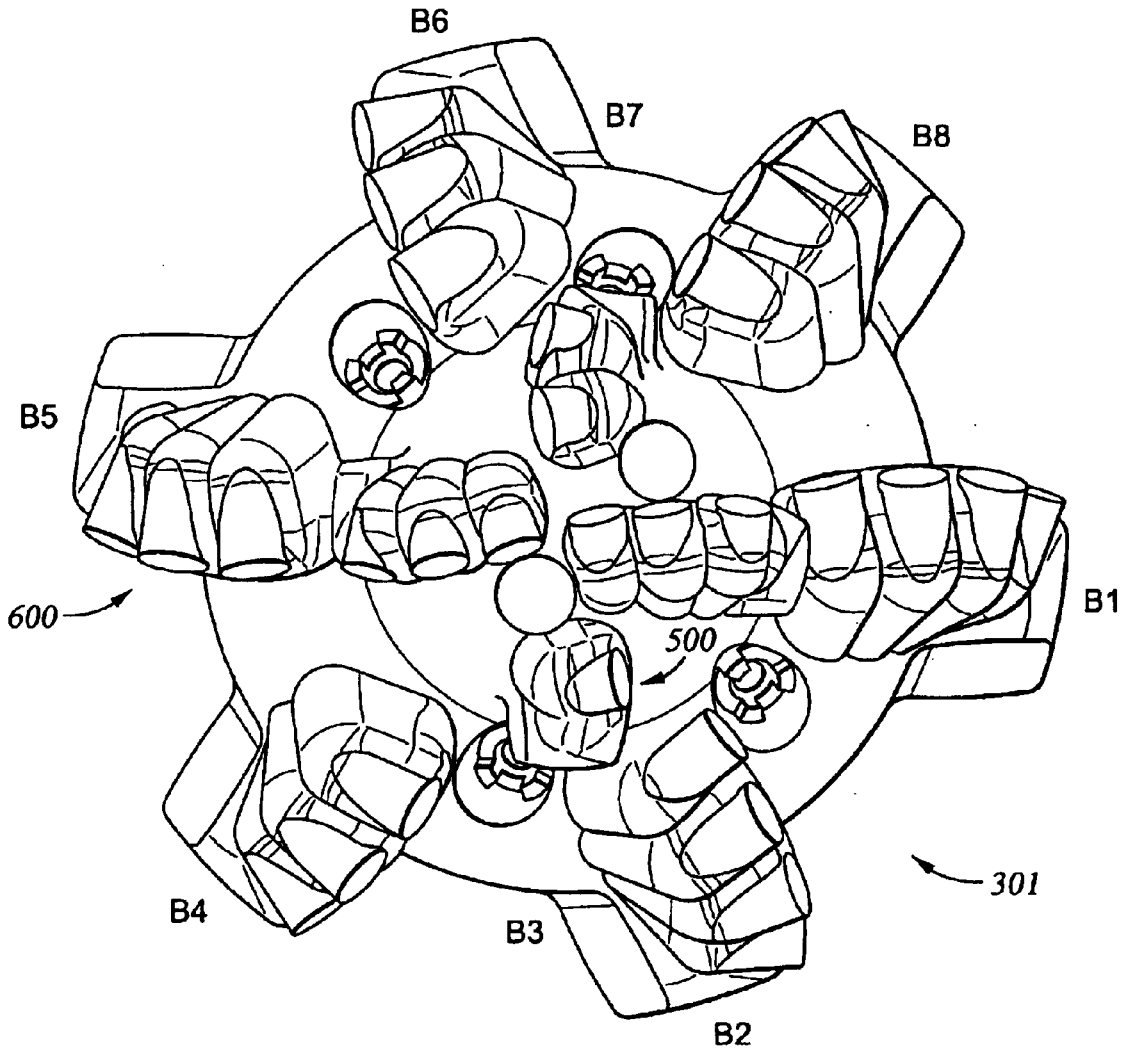
FIG. 4 is an end view of the drill bit of the drill bit of FIG. 3.

Referring primarily to FIG. 4, the face 301 of the drill bit body 300 is shown. Eight blades, B1–B8, are also shown. Of course, the invention is not limited to drill bits having only eight blades and may have more or fewer as is required. Also shown are the first set of cutting elements 500 mounted on the pilot portion 310 and the second set of cutting elements 600 mounted on the reamer portion 320.

Referring back to FIG. 5, at least a portion of blades B1, B3, B5, and B7 lie in the pilot portion 310 of the bit. First set of cutting elements 500 are also shown mounted on the pilot portion of the bit. In particular, fourteen cutting elements labeled 1–14 are shown.

Referring back to FIG. 6, at least a portion of blades B1, B2, B4, B5, B6, and B8 lie on the reamer portion 320 of the drill bit. Second set of cutting elements 600 are also shown mounted on the reamer portion of the drill bit. In particular, twenty-six cutting elements labeled 1–26 are shown.

It is known that, generally speaking and all other things being equal, a larger drill bit has a lower ROP than a smaller drill bit. One advantage to having pilot and reamer portions on the bit as generally described is an improved ROP resulting from the initial drilling of a smaller radius borehole by the pilot portion followed by the larger radius reamer portion. This design approximates at the bottom of the borehole the cutting action of a smaller gage drill bit while cutting a larger size borehole.

Figure 6:
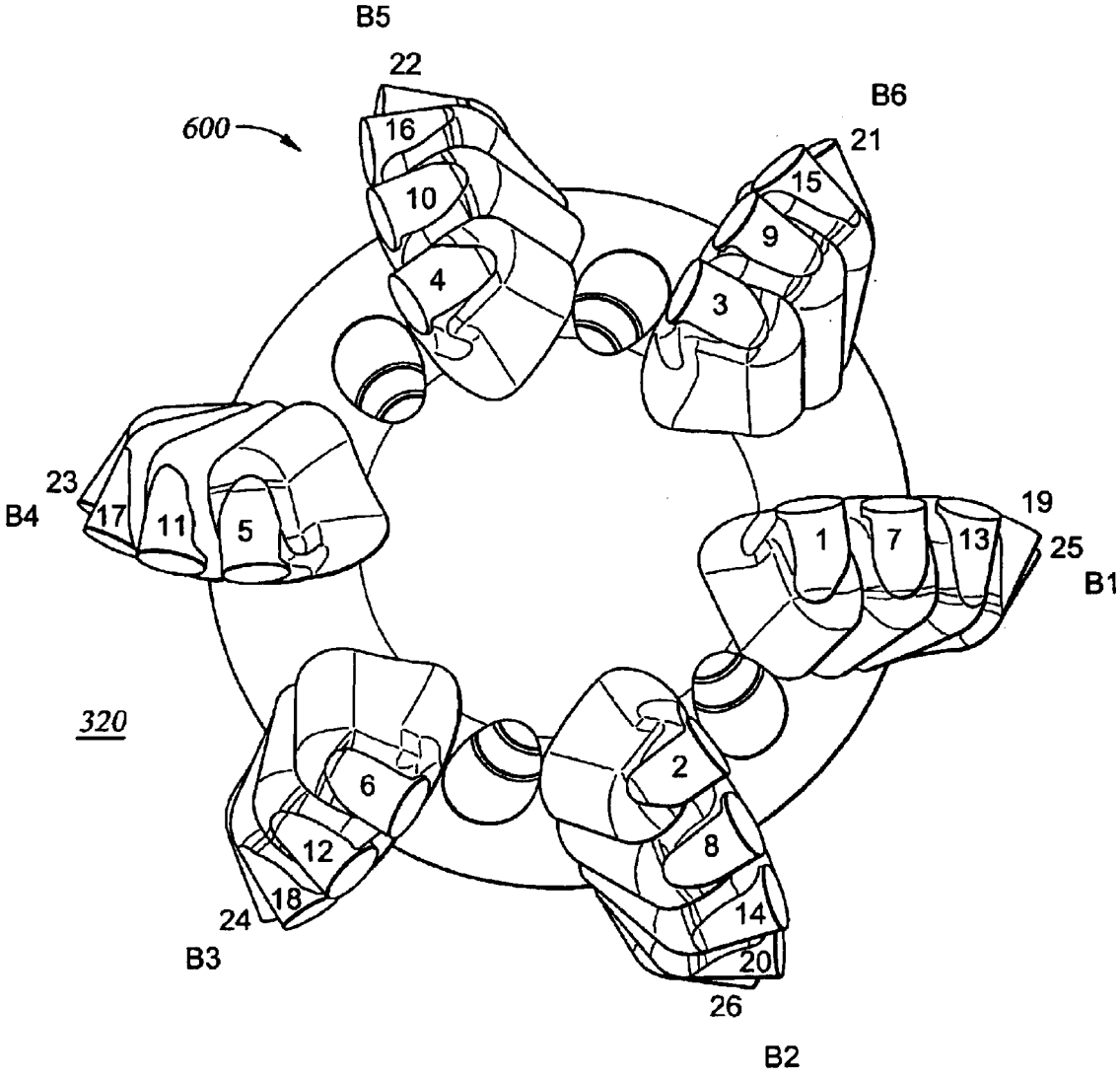
FIG. 6 is an end view of the reamer portion of the drill bit of FIG. 3.
Figure 7:
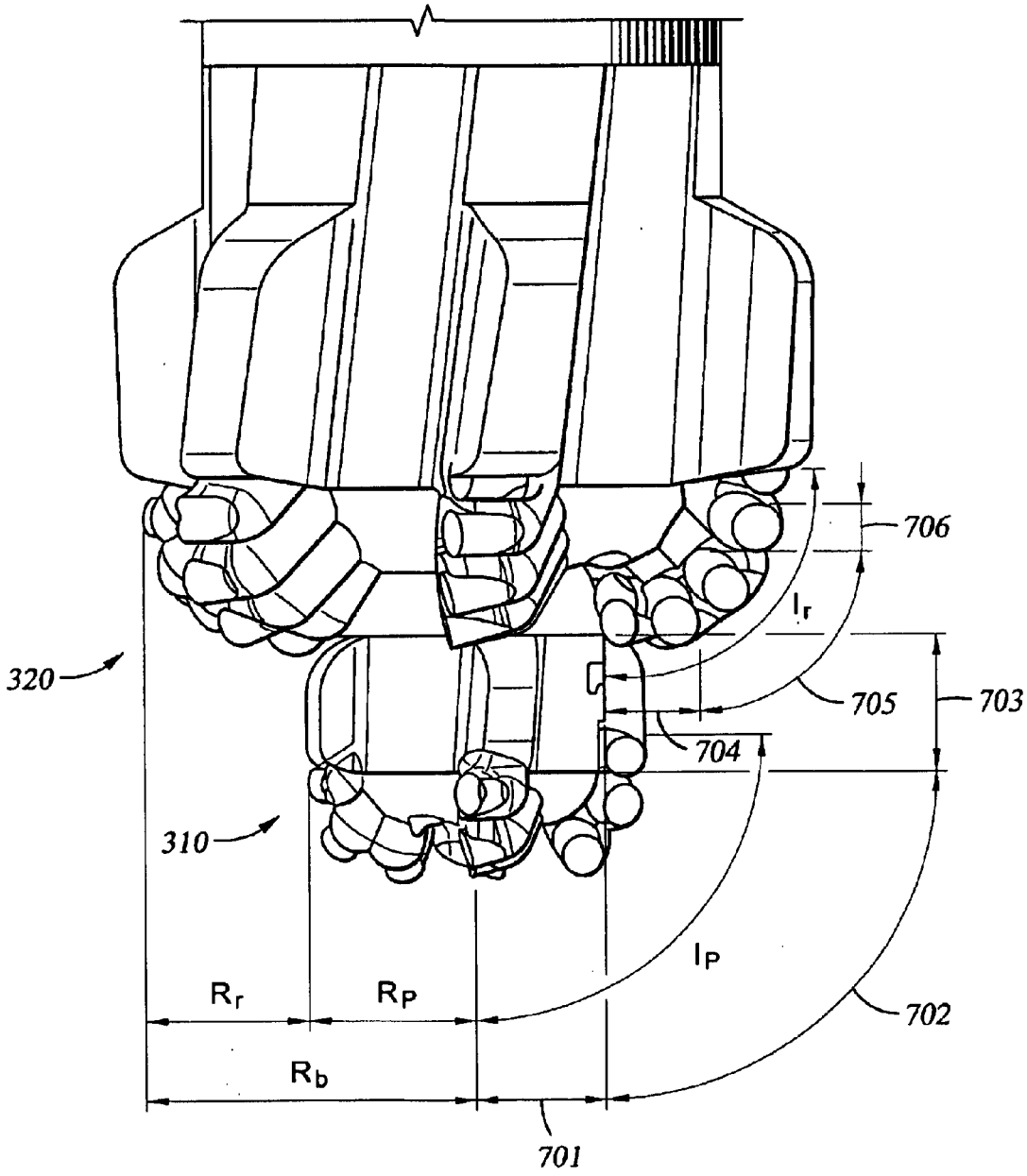
FIG. 7 is an enlarged view of the pilot and reamer portions of FIG. 3.

FIG. 7 shows the pilot 310 and reamer 320 portions of a PDC bit built in accordance with a preferred embodiment of the invention. Similar to a conventional drill bit, the pilot portion 310 includes a central pilot portion 701, a shoulder pilot portion 702, and a gage pilot portion 703 (the vertical portion of the pilot portion will be referred to as the gage pilot portion despite the fact that it does not cut to the gage diameter of the drill bit). The reamer portion 320 includes a central reamer portion 704, a shoulder reamer portion 705 and a gage reamer portion 706. The central pilot portion of the drill bit is generally defined at 701. The gage portion of the pilot is generally defined at 703. The shoulder 702 of the drill bit stretches from the central portion 701 to the gage pilot portion 703 of the drill bit. Referring back to FIG. 5, the first set of cutting elements 500 stretches from the center of the pilot portion to the gage region and establishes a length $l_p$. First length $l_p$ extends from the middle of central pilot portion 701 to the last cutter on pilot cutting elements 500. Referring to FIG. 6, the second set of cutting elements 600 begins at a radius corresponding to the outermost pilot portion cutting elements 500 and stretches up the gage surface of the reamer portion. Second length, $l_r$, extends from the innermost cutter of the reamer portion to the top or last cutter on the gage portion of drill bit. Also shown is a first radius, $R_p$, indicating the cutting radius of the pilot portion and a second radius $R_r$, reflecting the cutting radius of the reamer portion of the drill bit. The radius of the reamer portion begins where the pilot portion radius ends and extends to the gage (full) radius of the bit. A third radius, $R_b$, indicates the total radius of the drill bit and is the sum of $R_p$ and $R_r$, such that:

$$R_b = R_r + R_p \tag{1}$$

where, $R_b$=bit radius;

$R_r$=radius of reamer portion;

$R_p$=radius of the pilot portion.

In other words, the area of the reamer portion equals the total area drilled by the PDC bit minus the area drilled by the pilot portion of the bit according to the equation.

$$A_r = A - A_p \tag{2}$$

Where,

A=Full area of drill bit;

$A_p$=Area of pilot portion;

$A_r$=Area of reamer portion.

The radius of the pilot portion, $R_p$, may be set generally at 50%–80% of the radius of the bit, $R_b$. This ratio should be selected because it results in the pilot and reamer portions of the bit accomplishing approximately the same work (because of area and volume differences). In other words, preferably:

$$A_p \approx A_r \tag{3}$$

where, $A_p$=Area covered by the pilot portion of the bit; and $A_r$=Area covered by the reamer portion of the bit.

This may also be expressed as:

$$\pi R_p^2 \approx \pi (R_b - R_p)^2 \tag{4}$$

Since $R_r$ was defined as equal to $(R_b - R_p)$.

Based on this, the radius of the pilot portion should most preferably be about 70% of the reamer portion.

A drill bit built in accordance with the invention will include a distinct pilot cutting region with a relatively smaller cutting radius that extends downward from a distinct reamer cutting region that has a relatively larger cutting radius. At its most robust, the invention is a drill bit that evenly distributes torque and weight-on-bit on the reamer and pilot portions of the bit so that they work and wear at the same rate. Consequently, a drill bit in accordance with the invention will have some or all of the following relationships.

First, the radial and circumferential forces should be low. Every cutter on the bit during drilling generates several forces such as normal force, vertical force (i.e. along the longitudinal axis) (WOB), radial force, and circumferential force. All of these forces have a magnitude and direction, and thus each may be expressed as a force vector. The radial and circumferential forces should each total less than 5%, and preferably less than 3%, of the weight on bit (WOB). The total imbalance on the bit may be expressed as:

$$\overline{R_f} + \overline{C_f} = \overline{T} \tag{5}$$

where, $\overline{R_f}$=total of radial forces;

$\overline{C_f}$=total of circumferential forces; and $\overline{T}$=total imbalance of drill bit.

During the balancing of the bit, all of these force vectors are summed and the force imbalance force vector magnitude and direction can then be determined. The process of balancing a drill bit is the broadly known process of ensuring that the force imbalance force vector is either eliminated, or is properly aligned. Even drill bits that appear relatively similar in terms of cutter size and blade count may differ significantly in their drilling performance because of the way they are balanced.

The total imbalance, $\overline{T}$, on the drill bit should be less than 6% of the weight on bit, and preferably less than 4%. As is known in the art, radial and circumferential forces can be affected, amongst other things, by the backrake of the cutting elements. As is standard in the art, backrake may generally be defined as the angle formed between the cutting face of the cutter element and a line that is normal to the formation material being cut. Thus, with a cutter element having zero backrake, the cutting face is substantially perpendicular or normal to the formation material. Similarly, the greater the degree of back rake, the more inclined the cutter face is and therefore the less aggressive it is. Radial and circumferential forces are also affected by the siderake of the cutting elements and the cutter height of the cutting elements relative to each other, as is generally known in the art. In addition, the angles between certain pairs of blades and the angles between blades having cutting elements in redundant positions affects the relative aggressiveness of zones on the face of the drill bit and hence the torque distribution on the bit (blade position is used to mean the position of a radius drawn through the last or outermost non-gage cutter on a blade). Iterative adjustment of these criteria results in a drill bit having low imbalance.

Second, a drill bit built in accordance with the invention will preferably have these characteristics:

$$\frac{WOB_p}{A_p} \le \frac{WOB}{A} \tag{6}$$

$$\frac{WOB_r}{A_r} \le \frac{WOB}{A} \tag{7}$$

Where

WOB=full weight on bit;

$WOB_p$=weight on pilot portion of bit;

$WOB_r$=weight on reamer portion of drill bit;

$A_p$=Area cut by pilot portion of drill bit; and $A_r$=Area cut by reamer portion of drill bit.

Following these characteristics results in a drill bit that distributes WOB about evenly between the reamer and pilot portions of the bit. This even distribution of WOB between the pilot and reamer portions is highly desirable in achieving an equal or near equal rate of penetration (ROP) for each portion of the bit, resulting in a bit that has the highest overall ROP.

Third, the torque on the bit should also be balanced for each portion (i.e. pilot and reamer) of the drill bit. This reduces vibration of the bit. Vibration of the bit while drilling reduces ROP and causes wear to the drill bit, shortening its useful life.

The torque of the cutting elements on the drill bit depends on rock hardness. Balancing of the drill bit for torque should be in accordance with the relationship:

$$\frac{TQ_p}{TQ_r} \cong \frac{l_p}{l_r} \tag{9}$$

$$\frac{TQ_p}{TQ_r} = 0.6 - 1.2 \tag{10}$$

$$\frac{l_p}{l_r} = 0.6 - 1.2 \tag{11}$$

where, $TQ_p$=torque of pilot portion;

$TQ_r$=torque of reamer portion;

$l_p$=length of cutting elements on pilot portion; and $l_r$=length of cutting elements on reamer portion.

As shown, these ratios should each be in the range of 0.6 to 1.2, and preferably be in the range of 0.7 to 1.0. It is believed that the ideal ratio for $TQ_p/TQ_r$ and $l_p/l_r$ is approximately 0.72. It is not necessary, however, that the ratios $TQ_p/TQ_r$ and $l_p/l_r$ be identical.

As described above with reference to FIG. 7, $l_p$ and $l_r$ are defined with reference to the cutting portions of the pilot and reamer portions, respectively. The torque for each portion can be adjusted by adjusting the cutting profile of the drill bit, making it flatter or more rounded. This also affects the corresponding length of the cutting profile. Thus determination of the exact cutting profile required to satisfy the above relationships is an iterative process.

Fourth, another desirable characteristic of a drill bit designed in accordance with a preferred embodiment of the invention is establishing stress equivalency between the reamer and pilot portions. Preferably, the average cutter size for the cutting elements on the reamer portion should be larger than the average cutter size of the cutting elements on the pilot portion. Even more preferably, the average size of the cutting elements on the reamer portion should be at least 1.2 times the average size of the cutting elements on the pilot portion. In addition or in the alternative, the average backrake of cutting elements in the reamer portion should be higher than the average backrake of the cutting elements in the pilot portion. Preferably, the average backrake of cutting elements in the reamer portion is less than 20 degrees higher than the average of the cutting elements on the pilot portion. Even more preferably, the average backrake of cutting elements in the reamer portion is near 10 degrees higher than the average of the cutting elements on the pilot portion. However, the ideal relationships will alter depending on other factors affecting the stress equivalency between the pilot and reamer portions. These relationships compensate for the relatively greater wear on the outside cutting elements on the reamer portion since those cutting elements travel further (with correspondingly greater wear) with each rotation than the inside cutting elements on the pilot portion.

A number of software programs are available to model a particular design of drill bit and help to determine if the design satisfies the above-described conditions. For example, given the design file for the drill bit, rotations per minute (RPM) on the drill string, the drill bit's rate of penetration and the compressive strength of the formation through which the drill bit is cutting, the software can provide the torque created by the pilot portion 310 and the reamer portion 320, the imbalance force and the percent imbalanced, and the penetration rate. The Amoco Balancing software known in the industry or a program like it is preferred because it provides the radial imbalance force and the circumferential imbalance force for a given drill bit design. The invention thus also includes a method of designing a drill bit that achieves the proper reduction in radial and circumferential forces while at the same time distributing the torque and weight on bit about evenly between the pilot and reamer portions. In the context of the invention, balancing means the elimination or reduction of non-vertical forces. By balancing first the pilot portion independently, and then the bit as a whole, the drill bit is balanced with respect to both the pilot and reamer portions.

While preferred embodiments of this invention have been shown and described, modifications thereof can be made by one skilled in the art without departing from the spirit or teaching of this invention. The embodiments described herein are exemplary only and are not limiting. Accordingly, the scope of protection is not limited to the embodiments described herein, but is only limited by the claims which follow, the scope of which shall include all equivalents of the subject matter of the claims.

What is claimed is:

1. A drill bit, comprising:

a drill bit body having a pin end and a cutting end and defining a longitudinal axis;

a reamer portion connected to said cutting end of said drill bit body;

a first set of cutting elements mounted to said reamer portion, said first set of cutting elements defining a reamer cutting radius;

a pilot portion connected to and extending from said reamer portion, said pilot portion defining a pilot shoulder;

a second set of cutting elements connected to said pilot portion, said second set of cutting elements defining a pilot cutting radius less than said reamer cutting radius;

wherein the weight on bit and torque is about evenly distributed between said pilot portion and said reamer portion of said drill bit.

2. The drill bit of claim 1, wherein said weight on bit is distributed according to the relationships:

$$\frac{WOB_p}{A_p} \leq \frac{WOB}{A} \text{ and } \frac{WOB_r}{A_r} \leq \frac{WOB}{A}$$

where $WOB_p$=weight on pilot portion of bit;

$WOB_r$=weight on reamer portion of bit;

WOB=full weight on bit;

$A_r$=Area cut by reamer portion of drill bit $A_p$=Area cut by pilot portion of drill bit; and A=full area cut by drill bit and further wherein the ratio of the weight on bit for the pilot portion to the weight on bit for the reamer portion falls in the range of 0.6 to 1.2.

3. The drill bit of claim 1, wherein the total imbalance of the radial and circumferential forces on the drill bit is less than four percent.

4. The drill bit of claim 1, wherein said each cutter in said first set of cutting elements is larger than each cutter in said second set of cutting elements.

5. The drill bit of claim 1, wherein the average size of the cutting elements in said first set of cutting elements is about 1.2 times larger than the average size of the cutting elements in said second set of cutting elements.

6. The drill bit of claim 1, wherein the ratio of the torque on the pilot portion to the torque on the reamer portion is in the range of 0.6 to 1.2.

7. The drill bit of claim 1, wherein the ratio of the torque on the pilot portion to the torque on the reamer portion is in the range of 0.7 to 1.0.

8. The drill bit of claim 1, wherein said first set of cutting elements define a length along said reamer portion, and said second set of cutting elements define a length along said pilot portion, the ratio of said second length to said first length being in the range of 0.6 to 1.2.

9. The drill bit of claim 1, wherein said pilot cutting radius is from 50 percent to 80 percent of said reamer cutting radius.

10. The drill bit of claim 1, wherein said first set of cutting elements has a first average backrake value and said second set of cutting elements has a second average backrake value, said first average backrake value being higher than said second average backrake value.

11. The drill bit of claim 1, wherein the average size of the cutting elements in the first set of cutting elements in larger than the average size of the cutting elements in the second set of cutting elements.

12. The drill bit of claim 1, wherein the ratio of the torque on the pilot portion to the torque on the reamer portion is in the range of 0.6 to 1.2 and wherein said weight on bit is distributed according to the relationships:

$$\frac{WOB_p}{A_p} \leq \frac{WOB}{A} \text{ and } \frac{WOB_r}{A_r} \leq \frac{WOB}{A}$$

where $WOB_p$=weight on pilot portion of bit;

$WOB_r$=weight on reamer portion of bit;

WOB=full weight on bit;

$A_r$=Area cut by reamer portion of drill bit $A_p$=Area cut by pilot portion of drill bit; and A=full area cut by drill bit and further wherein the ratio of the weight on bit for the pilot portion to the weight on bit for the reamer portion falls in the range of 0.6 to 1.2.

13. The drill bit of claim 12, wherein die total imbalance of the radial and circumferential forces on the drill bit is less than four percent of the ideal weight on bit.

14. The drill bit of claim 12, wherein said first set of cutting elements define a length along said reamer portion, and said second set of cutting elements define a length along said pilot portion, the ratio of said second length to said first length being in the range of 0.6 to 1.2.

15. The drill bit of claim 12, wherein said first set of cutting elements has a first average backrake value and said second set of cutting elements has a second average backrake value, said first average backrake value being higher than said second average backrake value and further wherein the average size of the cutting elements in the first set of cutting elements in larger than the average size of the cutting elements in the second set of cutting elements.

16. The drill bit of claim 12, wherein the total imbalance of the radial and circumferential forces on the drill bit is less than four percent of the ideal weight on bit, said first set of cutting elements has a first average backrake value and said second set of cutting elements has a second average backrake value, said first average backrake value being higher than said second average backrake value and further wherein the average size of the cutting elements in the first set of cutting elements in larger than the average size of the cutting elements in the second set of cutting elements.

17. The drill bit of claim 1, wherein said weight on bit for said pilot portion points in the same direction as said weight on bit for said reamer portion and said torque for said pilot portion points in the same direction as said torque for said reamer portion.

18. A method for designing a drill bit, comprising:

a) establish a pilot portion to reamer portion cutting ratio of 0.5 to 0.8 for a drill bit having a reamer portion on the face end of a drill bit body and a pilot portion extending from said reamer portion;

b) independently balancing said pilot portion such that the radial and circumferential forces exercised by said pilot portion during drilling will be less than 5% of the force applied along the longitudinal axis of the drill bit;

c) balancing the drill bites a whole such that the radial and circumferential forces exercised by said drill bit during drilling will be less than 5% of the force applied along the longitudinal axis of the drill bit and further wherein the torque and weight on bit is distributed about evenly between said pilot portion and said reamer portion.

19. The method of claim 17, further comprising:

providing stress equivalency between said reamer portion and said pilot portion by adjustment of one or more of average backrake and average cutter size, the average backrake of cutting elements on said reamer portion being greater than or equal to said average backrake of cutting elements on said pilot portion end the average size of said cutting elements on said reamer portion being larger than or equal to the average size of said cutting elements on said pilot portion.

20. The method of claim 19, wherein said step of balancing the drill bit as a whole includes iterative adjustment of portions of the drill bit to achieve a ratio of the torque on the pilot portion to the torque on the reamer portion in the range of 0.6 to 1.2 and wherein said weight on bit is distributed according to the relationships:

$$\frac{WOB_p}{A_p} \leq \frac{WOB}{A} \text{ and } \frac{WOB_r}{A_r} \leq \frac{WOB}{A}$$

where $WOB_p$=weight on pilot portion of bit;

$WOB_r$=weight art reamer portion of bit;

WOB=full weight on bit;

$A_r$=Area cut by reamer portion of drill bit $A_p$=Area cut by pilot portion of drill bit; and A=full area cut by drill bit and further wherein the ratio of the weight on bit for the pilot portion to the weight on bit for the reamer portion falls in the range of 0.6 to 1.2.

21. The method of claim 20, wherein said iterative adjustment is made of one or more of the following: cutter backrake, cutter siderake, cutter height, cutter size, and blade spacing.

22. The method of claim 19, wherein said average cutter size of the cutting elements on said reamer portion is at least 1.2 times the average cutter size of the cutting elements on said pilot portion.

23. The method of claim 19, wherein the drill bit has the relationships:

$$\frac{TQ_p}{TQ_r} \cong \frac{l_p}{l_r}$$

$$\frac{TQ_p}{TQ_r} = 0.6 - 1.2$$

$$\frac{l_p}{l_r} = 0.6 - 1.2$$

where, $TQ_p$=torque of pilot portion;

$TQ_r$=torque of reamer portion;

$l_p$=length of cutting elements on pilot portion; and $l_r$=length of cutting elements on reamer portion.

24. The method of claim 18, wherein said step of balancing the drill bit as a whole includes iterative adjustment of portions of the drill bit to achieve a ratio of the torque on the pilot portion to the torque on the reamer portion in the range of 0.6 to 1.2 and wherein said weight on bit is distributed according to the relationships:

$$\frac{WOB_p}{A_p} \leq \frac{WOB}{A} \text{ and } \frac{WOB_r}{A_r} \leq \frac{WOB}{A}$$

where $WOB_p$=weight on pilot portion of bit;

$WOB_r$=weight on reamer portion of bit;

WOB=full weight on bit;

$A_r$=Area out by reamer portion of drill bit $A_p$=Area cut by pilot portion of drill bit; and A=full area cut by drill bit and further wherein the ratio of the weight on bit for the pilot portion to the weight on bit for the reamer portion falls in the range of 0.6 to 1.2.

25. The face end of a drill bit, comprising:

a) establish a drill bit design with a reamer portion on the face end of a drill bit body and a pilot portion extending from said reamer portion;

b) provide stress equivalency between said reamer portion and said pilot portion by adjustment of one or more of average backrake and average cutting element size, the average backrake of cutting elements on said reamer portion being greater than or equal to said average backrake of cutting elements on said pilot portion and the average size of said cutting elements on said reamer portion being larger than or equal to the average size of said cutting elements on said pilot portion.

c) independently balance said pilot portion such that the radial and circumferential forces exercised by said pilot portion during drilling will be less than about 5% of the force applied along the longitudinal axis of the drill bit;

d) balancing the drill bit as a whole such that the radial and circumferential forces exercised by said drill bit during drilling will be less than about 5% of the force applied along the longitudinal axis of the drill bit and further wherein the torque and weight on bit is distributed about evenly between said pilot portion and said reamer portion.

26. The method of claim 25, wherein said step of balancing the drill bit as a whole includes iterative adjustment of portions of the drill bit to achieve a ratio of the torque on the pilot portion to the torque on the reamer portion in the range of 0.6 to 1.2 and wherein said weight on bit is distributed according to the relationships;

$$\frac{WOB_p}{A_p} \leq \frac{WOB}{A} \text{ and } \frac{WOB_r}{A_r} \leq \frac{WOB}{A}$$

where $WOB_p$=weight on pilot portion of bit;

$WOB_r$=weight on reamer portion of bit;

WOB=full weight on bit;

$A_r$=Area cut by reamer portion of drill bit $A_p$=Area cut by pilot portion of drill bit; and A=full area cut by drill bit and further wherein the ratio of the weight on bit for the pilot portion to the weight on bit for the reamer portion falls in the range of 0.6 to 1.2.

27. The method of claim 26, wherein said average cutter size of the cutting elements on said reamer portion is at least 1.2 times the average cutter size of the cutting elements on said pilot portion.

28. The chill bit of claim 25, wherein the total imbalance of the radial and circumferential forces on the drill bit is less than four percent of the ideal weight on bit.

29. The drill bit of claim 25, wherein cutting elements along said pilot portion define a first length, and cutting elements along said reamer portion define a second length, the ratio of said first length to said second length being in the range of 0.6 to 1.2.

* * * * *